US005120213A

United States Patent [19]

Bühler et al.

[11] Patent Number: 5,120,213

[45] Date of Patent: Jun. 9, 1992

[54] APPARATUS FOR PRODUCING PRESSINGS PROVIDED WITH CHANNELS FROM POWDERY MOLDING COMPOUND, ESPECIALLY CERAMIC MOLDING COMPOUND

[75] Inventors: Eugen Bühler, Schleifweg 3, D-8871 Burtenbach; Klaus Strobel; Karl Schwarzmeier, both of Selb, all of Fed. Rep. of Germany

[73] Assignees: Hutschenreuther AG, Selb; Eugen Bühler, Burtenbach, both of Fed. Rep. of Germany

[21] Appl. No.: 711,282

[22] Filed: Jun. 6, 1991

Related U.S. Application Data

[60] Division of Ser. No. 344,364, Apr. 27, 1989, Pat. No. 5,039,296, which is a division of Ser. No. 128,086, Dec. 3, 1987, Pat. No. 4,853,170, which is a continuation of Ser. No. 936,149, Dec. 1, 1986, abandoned.

[30] Foreign Application Priority Data

Nov. 29, 1985 [DE] Fed. Rep. of Germany ..... 3542332

[51] Int. Cl.[5] ..... B28B 3/00

[52] U.S. Cl. ..... 425/356; 425/405.1; 425/405.2; 425/417; 425/440; 249/65; 249/178; 249/183

[58] Field of Search ..... 425/405.1, 405.2, 256, 425/356, 416, 417, 419, 438, 440, 447; 264/102, 109, 123, 314, 517; 249/65, 122, 176, 178, 183

[56] References Cited

U.S. PATENT DOCUMENTS

| | | | |
|---|---|---|---|
| 20,460 | 8/1937 | Jeffrey | 264/102 |
| 3,015,855 | 1/1962 | Merkel | 264/314 |
| 3,561,079 | 2/1971 | Anderson | 264/314 |
| 4,128,375 | 12/1978 | Schubart | 425/405.2 |
| 4,473,526 | 9/1984 | Bühler et al. | 264/517 |

*Primary Examiner*—Jay H. Woo
*Assistant Examiner*—Jeremiah F. Durkin, II
*Attorney, Agent, or Firm*—Toren, McGeady & Associates

[57] ABSTRACT

Apparatus for producing press-molded articles having a plurality of cavities therein includes a mold cavity which can be filled with a particulate molding compound, which mold cavity contains rods sheathed with expandable tubes which can be expanded by means of a fluid under pressure conveyed into the space between the rods and the tubes: this causes compaction of the molding compound to form the pressed article, which can be removed from the mold after reduction of the fluid pressure to allow detumescence of the expandable tubes and withdrawal of these from the mold cavity so that the mold cavity can be opened to remove the shaped pressed article.

1 Claim, 6 Drawing Sheets

APPARATUS FOR PRODUCING PRESSINGS PROVIDED WITH CHANNELS FROM POWDERY MOLDING COMPOUND, ESPECIALLY CERAMIC MOLDING COMPOUND

This is a division of application of Ser. No. 07/344,364 filed Apr. 27, 1989, now U.S. Pat. No. 165,039,296, which, in turn, is a divisional of Ser. No. 07/128,086, filed Dec. 3, 1987, now U.S. Pat. No. 4,853,170 issued Aug. 1, 1989, which, in turn, is a continuation of Ser. No. 06/936,149 filed Dec. 1, 1986, now abandoned.

BACKGROUND OF THE INVENTION

The invention relates generally to a process and apparatus for producing press-molded articles from a particulate material, and particularly to a process and apparatus for producing press-molded articles having cavities therein.

Press-molded articles produced by the process of the invention may be further processed to obtain bodies which have a large internal surface area for use in physical and chemical reactions. For this the molded bodies may be microporous, that is having capillaries extending between individual cavities, which capillaries for their part serve to increase the internal surface area. It is also possible for the internal surface area to be formed exclusively by the cavities. In such physical or chemical processes the molding compound from which the pressed article is made may itself be a reactant, for instance a catalytic reactant, or the molding compound may be mixed with a substance which is a reactant, or the body may be coated with a substance, for example by vapour deposition, and for this coating to be effective as a reactant, for instance as a catalytic reactant.

Molded bodies obtained from the process of the invention may be used wherever large surface areas are needed, for example in the exchange of heat between aggressive media.

The final conversion of the press-molded articles formed by the process of the invention into molded bodies is achieved in any conventional, way, such as baking or sintering.

OBJECTS OF THE INVENTION

A primary object of the present invention is that of providing a process with the aid of which it is possible economically to obtain pressed articles with large internal surface areas.

Another object of the invention is to provide pressed articles having cavities therein, which have sufficient stability to be able to be subjected to the further processes for production of the finished article for example baking or sintering.

A further object of the invention is to provide pressed articles having cavities therein, which can be handled without the risk of substantial damage or destruction and which are furthermore so stable that they can be handled safely in the processes for converting them from molded pressed articles to finished articles.

SUMMARY OF THE INVENTION

According to one aspect of the present invention the above objects are achieved by a process for producing pressed articles having a plurality of cavities therein, from particulate material, said process comprising the steps of:

introducing into a mold cavity a plurality of rods sheathed with resiliently expandable tubes, said resiliently expandable tubes being fitted over said rods and not attached thereto over a major part of the surface: area of said expandable tubes whereby to define interior spaces within said expandable tubes, introducing a pressable particulate material into said mold cavity whereby to surround said sheathed rods and substantially to fill said mold cavity, closing said mold cavity, introducing a fluid under pressure into said interior space within said tubes whereby to cause said tubes to expand and thereby compress said particulate material within said mold cavity, withdrawing said pressure fluid from said interior spaces within said tubes to allow said tubes to return substantially to their original unexpanded dimensions spaced from cavities now formed in the compressed particulate material, withdrawing said sheathed rods from said mold cavity, and opening said mold cavity to allow removal therefrom of a pressed article formed from said particulate material.

The present invention also comprehends apparatus for producing pressed articles having a plurality of cavities therein, from particulate pressable material, comprising:

means defining a mold cavity, a plurality of rods, said rods being sheathed with expandable tubes at least over part of their length, each of said expandable tubes having a wall surface defining an interior space and being fitted over the associated said rod in such a way that said rod substantially fills said interior space but is not attached to said wall surface of said tube, rod support means carrying said sheathed rods, said rod support means being displaceable to move said sheathed rods between a first position inside said mold cavity and a second position outside said mold cavity, filling means for filling said mold cavity with pressable particulate material, and pressure fluid supply means operating to supply fluid under pressure to said interior spaces of said expandable tubes.

A suitable particulate material for use in the process of the invention is a spray-dried granulate material such as is described, for example, in DE-OS 31 01 236 on page 31, last paragraph and page 32, first paragraph.

In the process according to the invention, owing to the expansion of the expandable tubes under fluid pressure, which may be hydraulic pressure, very high pressures can be applied, which lead to isostatic compacting of the material, so that a high degree of stability after pressing and before baking, sintering or other hardening is obtained. After the fluid pressure is reduced in the expandable tubes these return immediately to their original size as a result of the elasticity of the materials used (for example rubber or other elastomers) so that it is then immediately possible to withdraw the rods, and with them the tubes. It has been found that cavities of very small calibre, for example with diameter of from 1 to 10 mm, can be obtained in this way, to produce press molded articles with a very large specific surface area such as are required in the detoxification of exhaust gas from commercial plants, and also in the detoxification of exhaust gas from motor vehicles.

The cavities may pass right through the press molded article if, for example, a through-flow of gas or liquid is required through the finished body. It is also possible, however, to form blind cavities, that is cavities closed at one end. This opens up possibilities which do not exist with extrusion, where to achieve closed cavities expensive sealing measures have to be taken. Such closed cavities are advantageous, for example, if the press-molded body is to be used as a soot filter for diesel engines.

The rods and expandable tubes for the process of the invention do require considerable expenditure on production, especially for forming cavities of small diameter. On the other hand the rods and tubes are only exposed to relatively low loads, even when the pressure applied by the fluid is quite high, because the load is absorbed by the molding compound or by guideways receiving the rods and tubes in the walls defining the mold cavity. Therefore, it can be expected that the apparatus of the invention will have a long service life.

The dimensions of the mold cavities, and thus of the finished articles, can be as large as is desired, depending on the techniques used for filling. If extremely large molded bodies are required it is possible, however, to produce bodies as building blocks for the required finished article by the process of the invention and to fit these together and optionally connect them together. On the other hand, if extremely small molded bodies are required it is also feasible to produce economically by the process of the invention press-molded bodies which are larger than the individual bodies required, and to subdivide these pressings either immediately after press-molding or after production of the finished molded body by sintering, baking or the like.

The pressing process, which is based essentially on the contribution of the expandable tubes, can also be aided by a membrane, which at least partially defines the mold cavity, being exposed on the side remote from the particulate molding compound to a fluid pressure, especially at the same time as the expandable tubes are acted on by the fluid pressure. The compacting component delivered by the membrane depends, of course, on the total cross section of the molded article produced and for a given pressure is smaller the larger the cross section.

In order to achieve an even pressure loading and to hold expenditure on apparatus as low as possible it is preferred that a generally cylindrical membrane enclosing the mold cavity in the manner of a jacket be used. Such membrane preferably has an axis substantially parallel to the length of the rods, which themselves are preferably oriented generally parallel to one another.

In order to obtain uniform charging of the mold cavity with the particulate molding compound before the pressing process is effected by inflating the tubes, it is preferred that the molding compound be introduced into the mold cavity when the sheathed rods are already present in the mold cavity.

It is further preferably, with regard to uniform charging of the molding compound into the mold cavity, that a filling technique be used in which a vacuum is applied to the mold cavity, the molding compound thereby being sucked in.

For details of this filling method reference is made to the explanations in DE-OS 31 01 236 the disclosure of which is incorporated herein by reference. In this connection it is recommended that the measures mentioned in the above published specification for fluidizing the molding compound upon introduction into the mold cavity should be used and the velocity of the molding compound particles entering the mold cavity should be kept low at least at the beginning of the filling process, so as to ensure that the air extraction openings through which the vacuum is applied to the mold cavity are not prematurely blocked up, which would impair the proper filling of the mold cavity.

In order to ensure that the press-molding is performed in as precisely controlled a manner as possible, it is preferred that while the expandable tubes, and possibly also the membrane (if provided) are being acted on by the fluid pressure, at least the ends of the rods should be held in a fixed position in relation to the mold cavity against displacement at right angles to their length. It has been found that in this way an exact distribution of the cavities and approximate constancy of cross section over the whole length of the cavities is achieved, so that it is even possible for several press-molded bodies obtained with the process of the invention to be connected together with their cavities aligned with one another.

In order to be able to introduce the rods into and remove them from the mold cavity together, there should be provided rod mounting means at one end of the rods and drive means for moving this rod mounting means. For this purpose the press ram of a press which is needed anyway to apply the mold closing force for the mold cavity may be employed. For rational production of the pressings it is additionally advantageous for a perforated end wall of the mold cavity, through which end wall the rods pass, to be connected to the rod mounting means for joint movement therewith. The said end wall can, indeed, form a substantial part of the rod mounting means. When the rods are withdrawn, the mold end wall through which the rods pass is raised with them. Should it happen that parts of the pressing may be touched by the rods during withdrawal and are thereby subjected to a risk of damage, it is also possible to disconnect the rod mounting means and the mold end wall in such a way that the rods can be withdrawn through the mold end wall before removal of this latter, so that the rods, at any rate at one end, are still guided by this mold and end wall unit completion of the withdrawal process.

If it is desired to obtain a pressing the cavities of which have the same cross section over their whole length, the expandable tubes may be formed to extend beyond the mold cavity, having end sections which, in order to protect them against excessive inflation (since they are not then protected against excessive inflation by the molding compound) may be housed in supporting channels which tightly enclose them in a mold end wall opposite that associated with the rod mounting means. Additional support may be provided at each end of the sheathed rods by a perforated squash plate pressed between two pressing members. Such a squash plate is made from compressible material, such as resilient or elastic material, having a plurality of apertures extending transversely of two major faces of the squash plate. The ends of the sheathed rods can be received in such apertures when no pressure is applied to the squash plate. When such pressure is applied across the two major faces, however, the apertures are squeezed down in size to grip tightly to the end of the rod therein. This gives both a fixing and a sealing effect. For this purpose the squash plate can be enclosed between that face of the associated perforated mold end wall remote from the mold cavity and a pressure plate which may likewise be perforated, this pressure plate being capable of being pressed by usual hydraulic or pneumatic means against the respective mold end wall.

The supply of fluid under pressure to the expandable tubes may be achieved by forming a fluid supply chamber in the apparatus, this fluid supply chamber possibly being located in the region of one mold end wall or of both mold end walls and possibly being formed such that the mold end wall forms one of the walls of the fluid supply chamber. The expandable tubes may be open at one end and communicate with the fluid supply chamber. To avoid the possibility of the expandable tubes closing when the fluid pressure is applied they may be widened at their open ends into a funnel shape or the rods may be constructed with fluid supply grooves on their surface and/or with fluid supply channels inside them. If fluid supply channels are formed inside the rods, the additional possibility arises of sealing the expandable tubes at one or both of their ends, by means of the respective rods, and of then supplying the fluid to the inside of the expandable tubes via the fluid supply channels inside the rods, these channels in turn being connected with the fluid supply chamber.

In a preferred embodiment both mold end walls are provided with squash plates, one squash plate being squeezed upon introduction of the rods into or their removal from the mold cavity and being relieved of load to effect inflation and the other being relieved of load during movement of the rods, so that the rods can pass through it, but being squeezed during inflation of the expandable tubes. In this embodiment expandable tubes which are open at both ends can be used; mounting of the rods and the expandable tubes at one end is particularly easy, as mounting can simply be effected by means of the associated squash plate. Installation of the sheathed rods is effected extremely easily, because the rods need only be inserted into the apertures in the squash plate in order then to be secured in the axial and transverse directions when the squash plate is squeezed.

It is not absolutely necessary for the tubes to be open at both ends for the purpose of inflation, but this does offer the advantage of rapid emptying of the expandable tubes upon removal of the fluid pressure.

The mold cavity may be provided with air extraction means and at least one molding compound inlet opening, if the mold filling process known from DE-OS 31 01 236 is to be used. In this connection the air extraction means may be constructed as an orbital gap or an orbital row of openings at the junction between one mold end wall and a mold shell and at least one molding compound inlet opening may be provided in the region between the mold shell and an opposing mold end wall. In this way the requirement set in DE-OS 31 01 236 is fulfilled, that the air extraction openings should be located around at least a maximum circumference of the mold cavity and the molding compound inlet should be located at a point as far as possible from the air extraction openings or the extraction gap. For details reference may be made in this respect to the disclosure of DE-OS 31 01 236 or the corresponding U.S. Pat. No. 4 473 526, the disclosure of which is incorporated herein by reference.

It can be advantageous to construct the mold cavity using two mold half shells, in order to facilitate release of the press-molded body. Such a construction makes it possible, in contrast, for example, to an extrusion process, to mold integrated shaped parts such as, for instance, holding flanges, onto the outside of the molded article, which shaped parts deviate in shape from the cylindrical or prismatic.

If the press-molded body is also formed by pressing from outside by means of an external membrane, a single mold shell can be used which supports the membrane on its inside face. The use of such a membrane also opens up the possibility of providing shaped parts on the outside of the molded article, shaped parts which again deviate from the cylindrical or prismatic molded article shape. The only prerequisite for this is that the possible withdrawal path of the membrane is made so that it is larger than the height of such shaped parts in relation to the surface of the molded article.

The molding compound inlet opening can be closed by a closing plunger with an end surface the shape of which matches the shape of the mold cavity, to avoid marks in the molding compound at the point of the molding compound inlet opening.

For ease of handling it is preferable that the rods lie substantially vertically inside the mold cavity and can be withdrawn upwards out of the mold cavity. This is also advantageous in order to prevent the rods from being under their own weight and thereby avoid problems of jamming which could arise if the rods and expandable tubes were to become engaged in the wrong openings in the opposite mold end wall. In an embodiment of this type, with vertical rods, it is preferred that the air extraction means be arranged in the lower region and the filling opening in the upper region of the mold cavity, thus further favouring the filling of the mold cavity.

Various other features and advantages of the present invention will become apparent from a study of the following descriptions of preferred embodiments, in which reference is made to the accompanying drawings, provided purely by way of non-limitative example.

DESCRIPTION OF THE PREFERRED EMBODIMENTS

Figure 1:
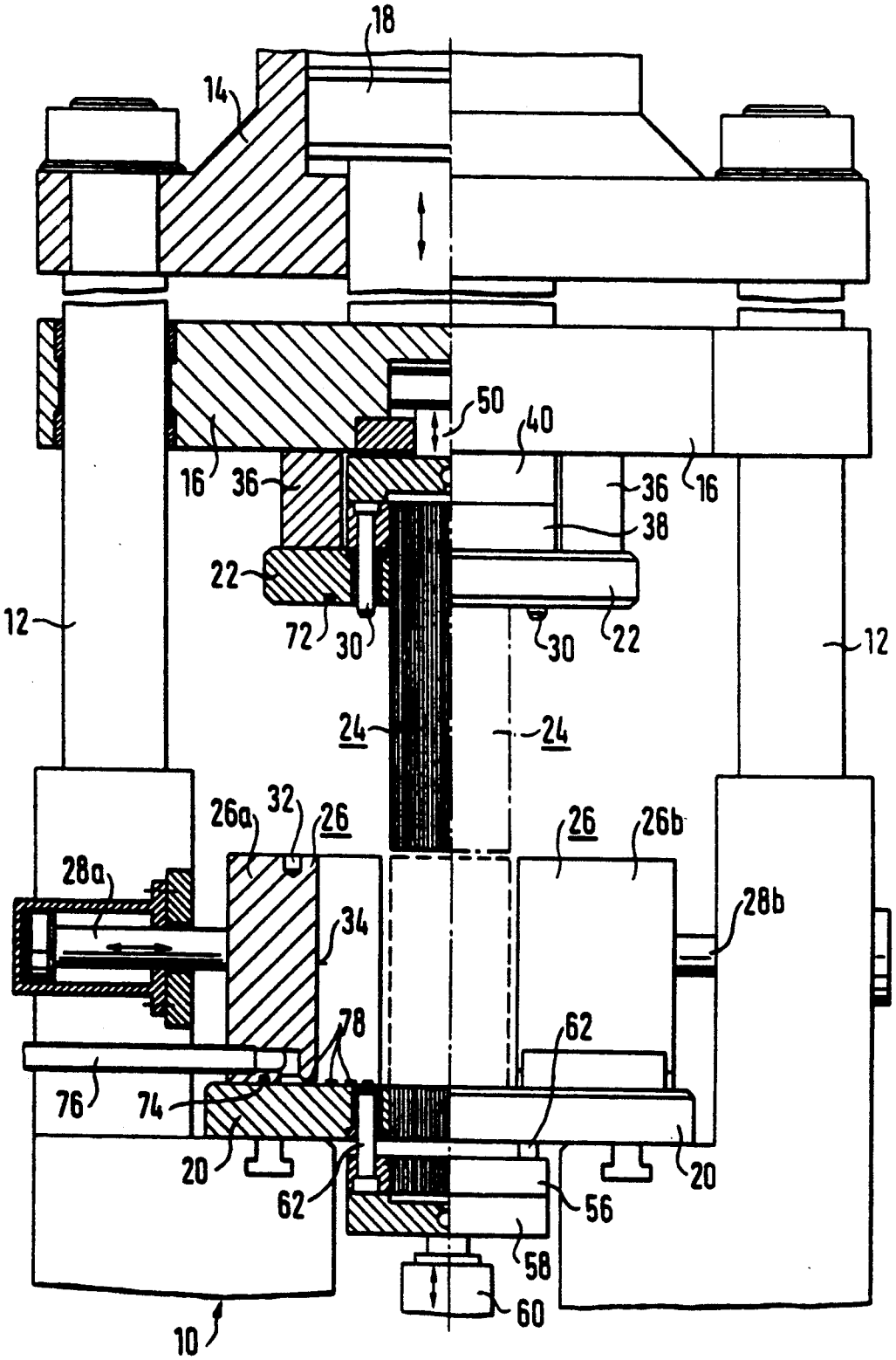
FIG. 1 is a partially sectional view of a press incorporating apparatus according to the invention, showing the rods withdrawn from the mold cavity and the mold cavity open.

In FIG. 1 the stand of a ceramic press is indicated by 10. Press guide rods 12 project upwards from this stand 10. These guide rods 12 are connected together at their upper end by a press yoke 14. A press ram 16 is guided vertically on the guide bars 12 and can be moved upwards and downwards by a hydraulic piston 18. A lower mold end wall 20 is mounted on the press stand 10. An upper mold end wall 22 and a set of vertical rods 24 sheathed in expandable tubes are arranged on the press ram 16. The rods 24 with the expandable tubes are separated from each other laterally. Also carried on the press stand 10 are two mold shell halves 26*a* and 26*b*, which together form a mold shell 26. The mold shell halves 26*a* and 26*b* can be moved between an open mold position shown in FIG. 1 and a closed mold position shown in FIG. 2 by means of auxiliary hydraulic rams 28*a* and 28*b*. Centering mandrels 30 are attached to the press ram 16 and engage in blind bores 32 in the mold shell 26 when the press ram 16 is moved downwards after closure of the mold shell 26, so as to locate the upper mold end wall 22 on the mold shell 26.

Figure 2:
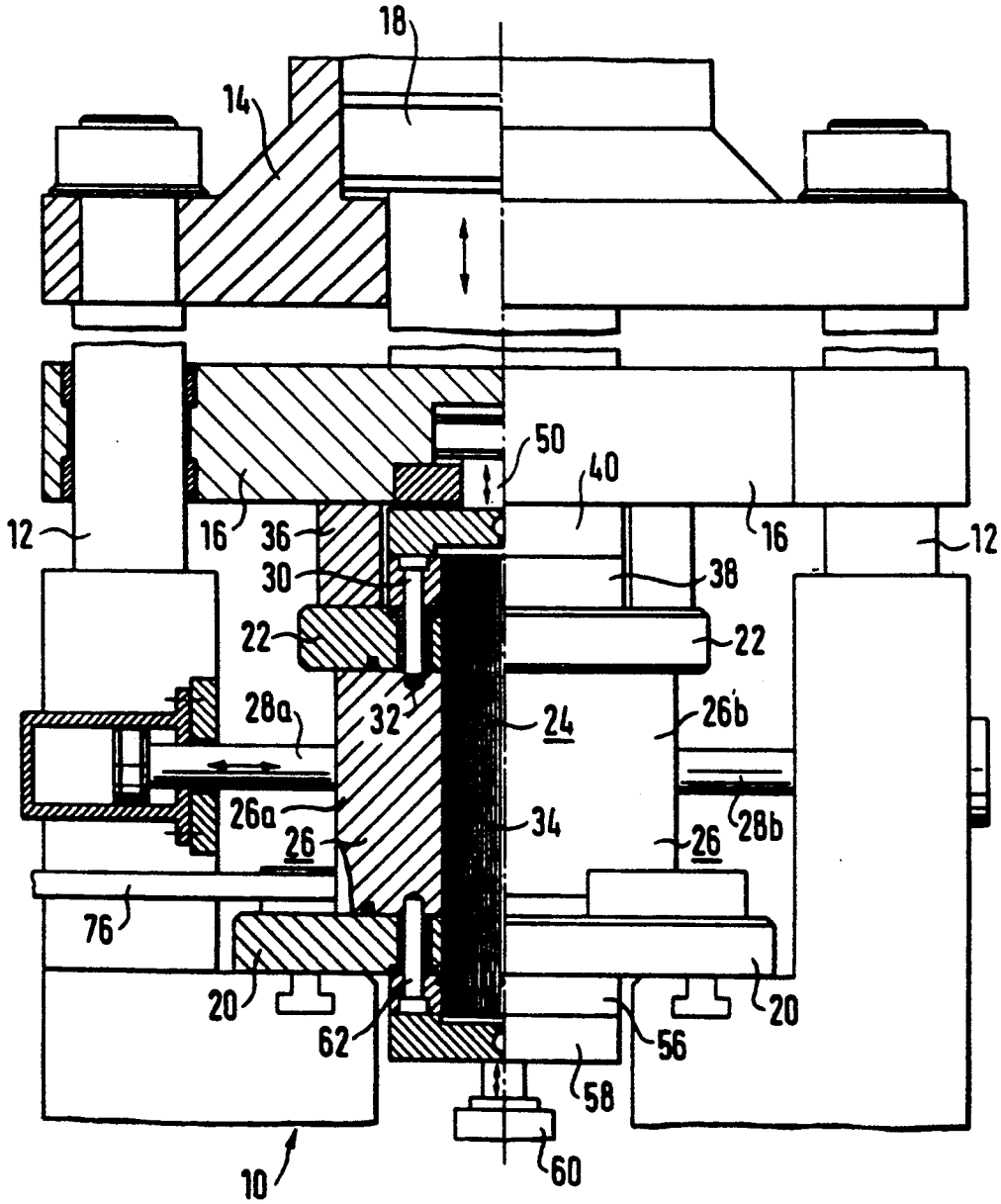
FIG. 2 is a view corresponding to that of FIG. 1, again partially in section, in which the rods are shown in position in the mold cavity and the shell of the mold cavity closed.

When the mold shell 26 is closed the press ram 16 is moved downwards, so that the sheathed rods 24 enter the mold cavity 34 within the mold shell 26 (FIG. 2). Then the mold cavity 34 is filled with particulate molding compound, the filling being assisted by a vacuum in the mold cavity as will be explained below. Next, the expandable tubes which surround the rod 24, are inflated so that a honeycomb pressing is obtained.

Figure 4:
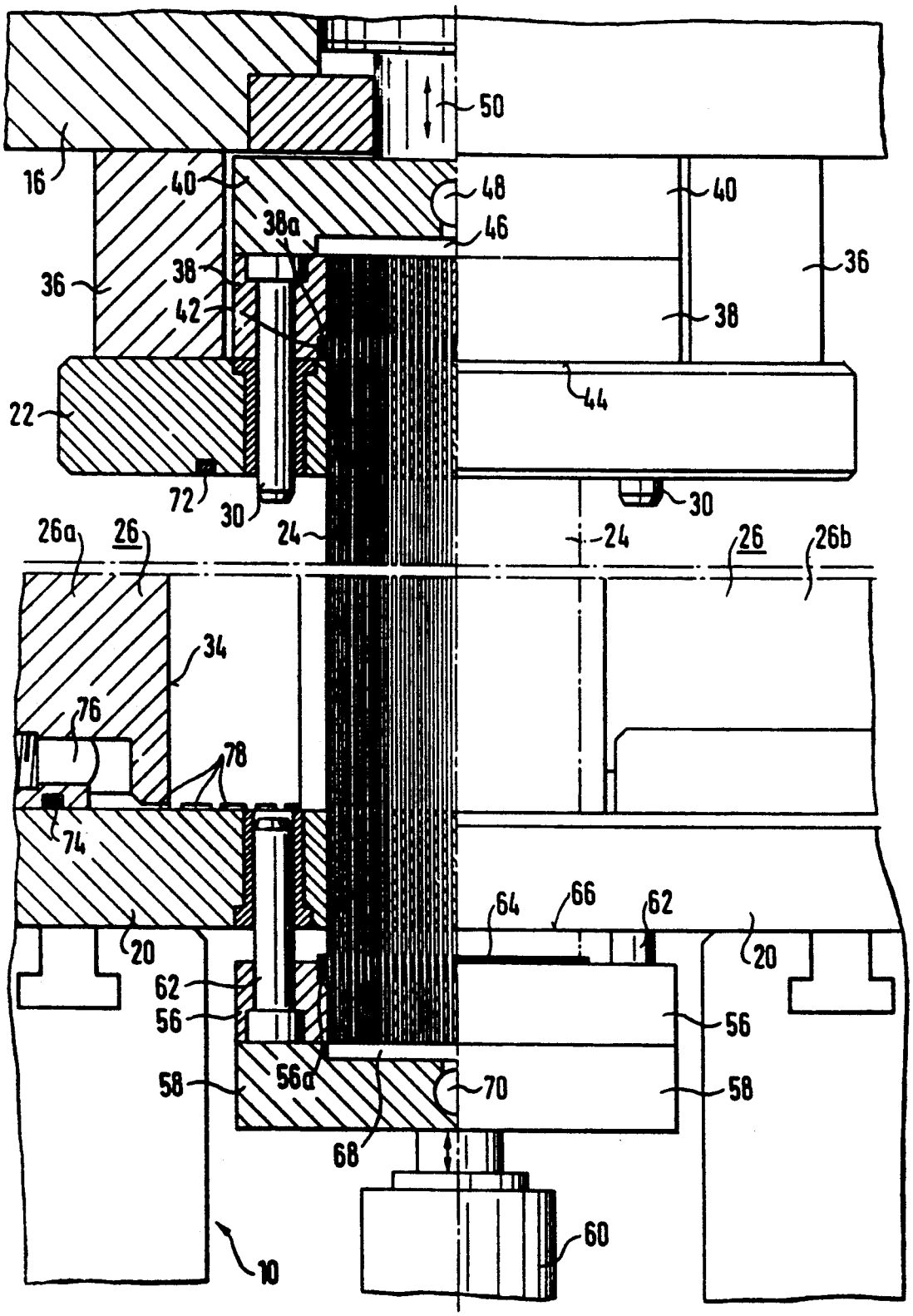
FIG. 4 is an enlarged view corresponding to FIG. 1, with the rods introduced into the mold cavity, the mold cavity shell and the rods being partially broken away.
Figure 5:
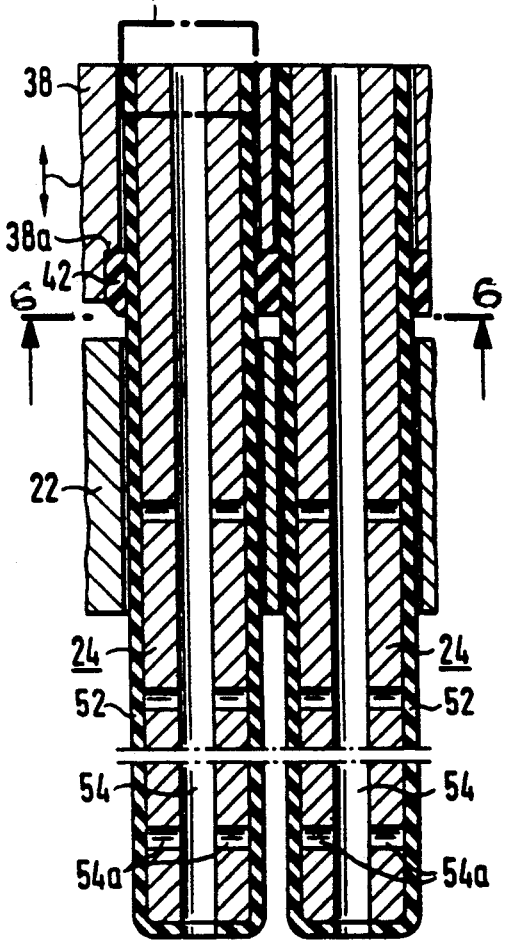
FIG. 5 is an enlarged, sectional view of the rods and their upper mounting.
Figure 6:
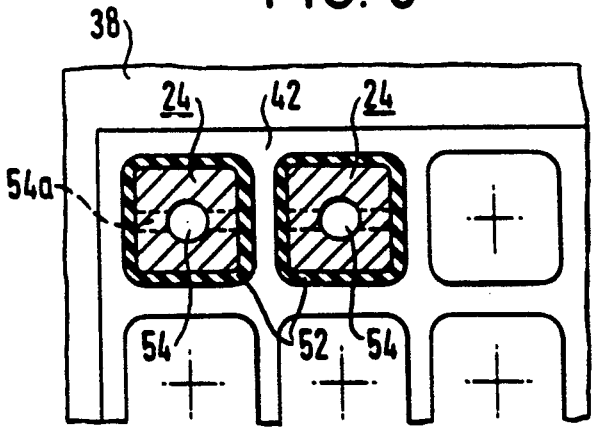
FIG. 6 is a section along line VI—VI of FIG. 5.

Further details are shown in FIGS. 4, 5 and 6, in which it can be seen that the upper mold end wall 22 is fastened to the press ram 16 by mans of spacers 36. Inside the spacers 36 there are mounted two interconnected pressure plates 38 and 40. The centering mandrels 30 are connected with these pressure plates 38 and 40. The lower pressure plate 38 has a plurality of apertures in which the rods 24 are received. As may be seen from FIG. 4, the upper end wall 22 is likewise pierced by a plurality of apertures for the passage of the rods 24. Between the pressure plate 38 and the upper mold end wall 22 there is formed a flat disk-shape space in which is housed an elastic squash plate 42, which lies between a pressure surface 44 of the upper mold end wall 22 and a pressure surface 38*a* of the pressure plate 38. Between the two pressure plates 38 and 40 there is formed a fluid supply chamber 46, which is connected to a fluid supply duct 48. The pressure plates 38 and 40 can be moved up and down with respect to the main press ram 16 by an auxiliary piston 50.

As may be seen from FIG. 5, the rods 24 are sheathed with expandable tubes 52. It can be seen that the rods 24 and the tubes 52 extend to the top of the pressure plate 38, that is they pass through bores in the upper mold end wall 22, the squash plate 42 and the lower pressure plate 38. The open upper ends of the expandable tubes communicate with the fluid supply chamber 46. Moreover, the rods 24 are provided with longitudinal internal passages which communicate with the fluid supply chamber 46, and transverse passages 54*a*, which together convey fluid to the inside of the expandable tubes 52.

Beneath the lower mold end wall 20, which is firmly mounted on the press frame 10, there are two pressure plates 56 and 58 which are controlled by an auxiliary piston 60. The pressure plate 56 has at least one mandrel 62 which can engage in a blind bore in the mold shell half 26*a* when the mold shell 26 is closed, so as to assist in holding the mold shell halves 26*a* and 26*b* together against press pressure. A similar mandrel (not shown) cooperates with a bore in the mold shell half 26*b*.

A squash plate 64 is housed between the upper pressure plate 56 and the lower mold end wall 20, between a pressure surface 66 of the mold end wall 20 and a pressure surface 56*a* of the pressure plate 56. The rods and the expandable tubes pass through the lower mold end wall 20, the lower squash plate 64 and the pressure plate 56, and the lower ends of the channels 54 communicate with a lower fluid supply chamber 68 connected to a fluid supply line 70.

The upper mold end wall 22 is provided with a ring seal 72 for resting on the mold shell 26; the mold shell halves 26*a* and 26*b* are provided with semi-circular sealing members which are indicated by 74 and rest on the lower mold end wall 20.

A vacuum line 76 is connected to the mold shell, in the region of the lower part of the mold shell half 26*a*, and leads to an annular array of exhaust openings 78. In a different embodiment (not shown) the individual openings may be replaced by a single annular gap. A molding compound supply channel 80 (FIG. 7) is connected to the upper mold end wall 22 and with a fluidizing air supply line 82. The molding compound supply line 80 opens into a molding compound supply bore 84, which leads to an opening 86 into the mold cavity 34. This opening 86 may be closed by a plunger 88. Several such mold compound inlets may be distributed around the circumference.

The mode of operation of the device described thus far is given below.

Initially, the apparatus is in the position shown in FIG. 1; then, by actuating the auxiliary pistons 28*a* and 28*b* the mold shell 26 is closed. Then the press ram 16 moves downwards, the sheathed rods 24 passing through the perforations in the lower mold end wall 20, the squash plate 64 and the pressure plate 56. In the position of FIG. 1 and during the downwards movement of the press ram 16 the sheathed rods 24 are held in place on the ram 16 by the squash plate 42 which is squeezed between the pressure surfaces 38*a* and 44. At the same time the squash plate 64 is relieved of load, so that the sheathed rods 24 with the expandable tubes 52, are able to pass unhindered through the perforations in the lower squash plate 64. As soon as the device has reached the position shown in FIGS. 2 and 4 the lower squash plate 64 is squeezed by actuators of the auxiliary piston 60, and the upper squash plate 42 is relieved of load. Now the rods 24 are held in place by the lower squash plate 64.

The mold cavity 34 is now filled with molding compound; for this purpose a vacuum is applied to the mold cavity 34 through the gaps 78 whilst the closing plunger 88 is withdrawn. The molding compound is sucked into the mold cavity 34 until the latter is completely filled, and even slightly precompressed between the rods 24. As long as the vacuum is applied to the mold cavity 34 via the openings 78, a corresponding vacuum must also be applied to the insides of the expandable tubes via the pressure fluid supply lines 48 and 70, to balance the pressures on either side of these expandable tubes so that they cannot lift off from the rods 24 under the effect of the vacuum in the mold cavity 34.

The molding compound sucked into the mold cavity is already somewhat precompressed by the relatively high impact velocity of the mold particles, it being necessary, though, by adjusting the impact velocity, to take care at least at the beginning of the filling process that the exhaust openings 78 do not become blocked up.

As soon as the mold cavity is full the vacuum applied to the internal surfaces of the expandable tubes 52 is disconnected and pressure is then applied via the passages 48 and 70 and the fluid supply chambers 46 and 68 to the internal surfaces of the expandable tubes 52, partly through the channels 54, 54*a* in the rods 24, and partly through the open ends of the tubes 52. In this way the expandable tubes are inflated and compact the molding compound inside the mold cavity 34. At the same time the rods 24 are unable to alter their position laterally, as they are secured firmly against lateral movement in the perforations in the end walls 20 and 22.

No inflation of the parts of the expandable tubes outside the mold cavity takes place as these parts of the expandable tubes are secured against inflation in the perforations in the mold end walls 20 and 22, the squash plates 42 and 64 and the pressure plates 38 and 56 and are in any case subjected at their ends simultaneously to the pressure of the fluid both internally and externally.

When the inflation process has led to sufficient compacting, the fluid pressure through the two fluid lines 48 and 70 is reduced again, so that now the expandable tubes return to their position tight against the rods 24. The squash plate 64 is relieved of load and the squash plate 42 is squeezed again. The press ram 16 can then travel upwards taking with it the rods, these being withdrawn through the perforations in the pressure plate 56, the squash plate 64 and the lower mold end wall 20.

Finally the mold shell halves 26*a* and 26*b* are separated, so that the finished pressing can be removed.

Figure 7:
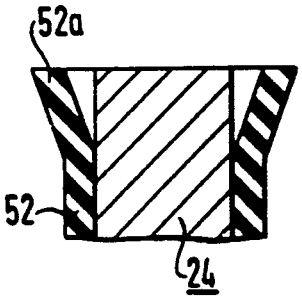
FIG. 7 is an enlarged view of the upper end of an expandable tube at point VII of FIG. 5.
Figure 8:
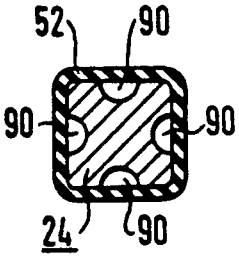
FIG. 8 is a rod construction differing from that of FIG. 6.
Figure 9:
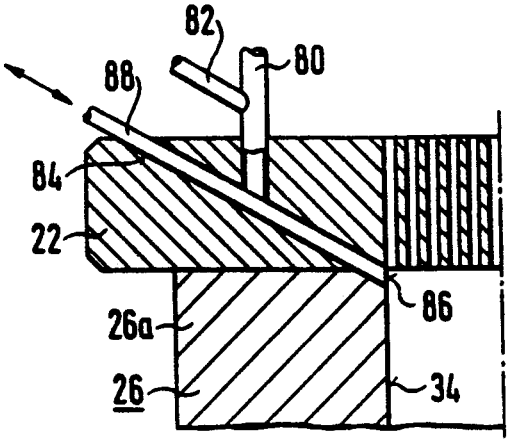
FIG. 9 is an inlet opening for filling the mold cavity with a particulate molding compound.

In the alternative embodiment shown in FIGS. 7 and 8 there are no channels inside the rods 24. Fluid is then supplied to the inside of the expandable tubes by means of the funnel-shaped upper ends 52*a* of the expandable tubes 52 (FIG. 7), filling of the expandable tubes being made possible by the upper squash plate 42 being relieved of load and the lower squash plate 64 being squeezed. Fluid need then only be supplied from the line 48 via the fluid supply chamber 46, because at their lower ends the expandable tubes are closed in a valve-like manner by the squash plate 64. In this latter embodiment filling of the expandable tubes is aided by the fact that the rods 24 are provided with surface grooves 90 which prevent the expandable tubes from unintentionally closing tightly against the rods 24 when the fluid pressure is applied to the ends of expandable tubes 52.

Figure 3:
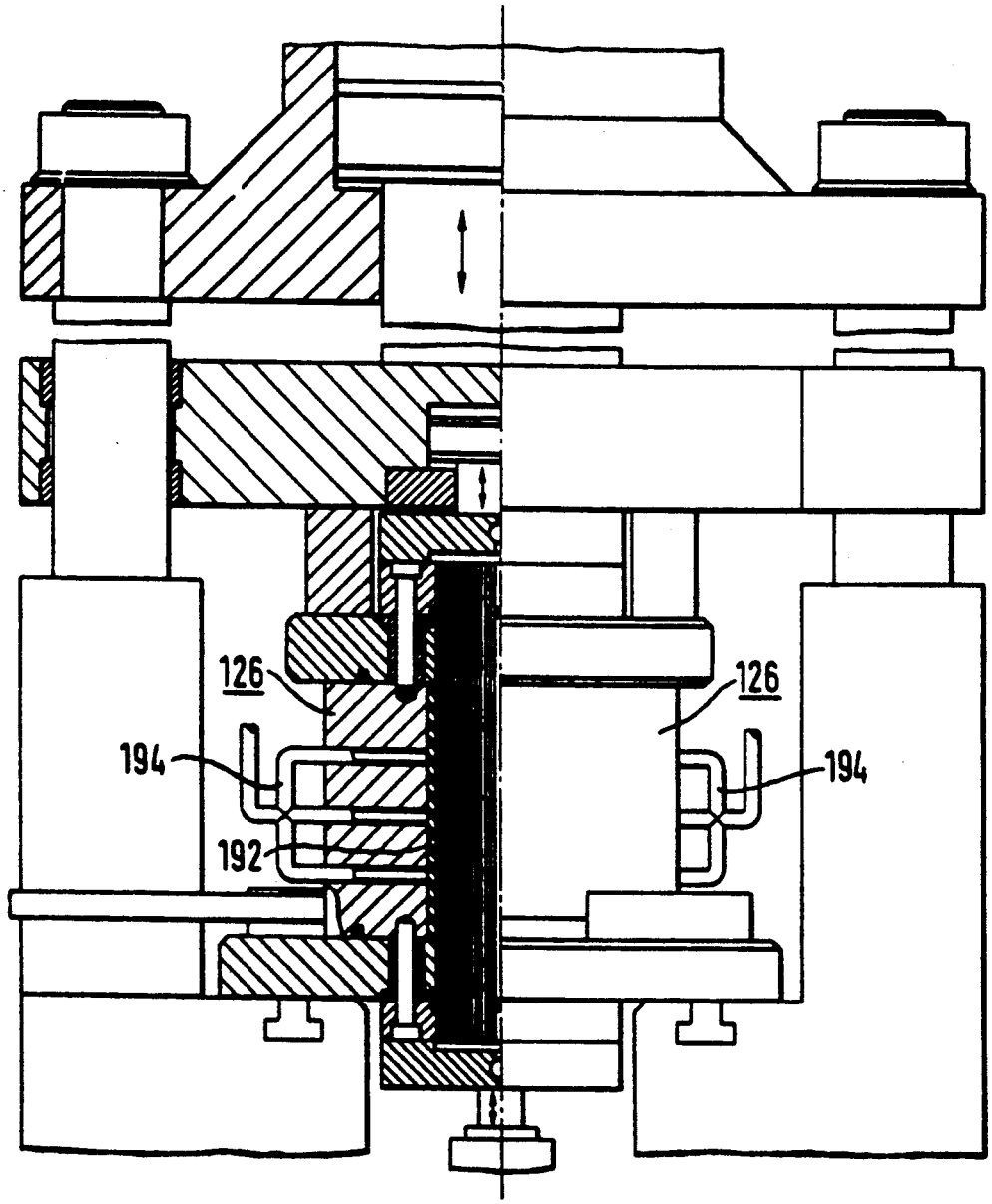
FIG. 3 is a view corresponding to FIG. 2 but of a different embodiment of the invention.

In the embodiment of FIG. 3 the mold shell 126 is a one-piece, annularly closed mold shell lined on its inside by a cylindrical membrane 192. The space at back of the cylindrical membrane 192 between the membrane and the mold shell 126 can be acted upon by a vacuum via a fluid supply system 194 when the mold cavity is being filled and by pressure when the molding compound is being compressed. The removal of the pressing must take place in the axial direction with an annularly closed mold shell. Naturally, it would be possible again to make the mold shell 126 in two parts and to divide the membrane 192 accordingly.

In the embodiment of FIG. 1 the mold shell halves 20*a* and 20*b* can be provided with shaped parts, for example shaped parts which provide the molded article with holding members or a holding flange. These shaped parts must, of course, be so formed as to take into account the direction of mold release. Such molded-on parts can be arranged either near the edge or between the edges of the mold shell halves 26*a*, 26*b*. In the embodiment of FIG. 3, shaped parts can be provided in the mold shell 126 and in the membrane 192, so as to produce shaped parts likewise on the molded article. Provided that these shaped parts extend parallel to the shell axis over the whole length of the internal surface of the mold shell 126 no problems arise during mold release. However, it is also possible to provide shaped parts on the internal surface of the mold shell 126 and on the membrane, so as to cause corresponding shaped parts to occur on the molded article, if these shaped parts do not extend over the whole height of the mold shell 126 but, for example, end at a distance from the upper edge and the lower edge of the mold shell; or to provide shaped parts which produce ribs or the like running around the molded article in the circumferential direction. In this case, care must be taken, regarding mold release, that either the mold shell is subdivided or that the return path of the membrane on release of the pressure and possibly the reapplication of the supporting vacuum is large enough to release the shaped parts present on the outside of the molded article with respect to the shaped parts of the membrane and possibly of the mold shell 126.

Figure 10:
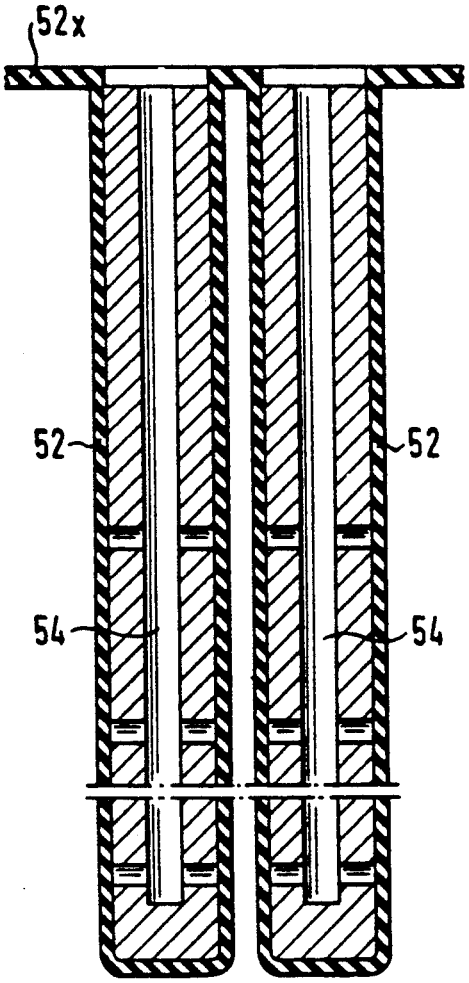
FIG. 10 is a view corresponding to FIG. 5 of a further embodiment of the invention.

The embodiment of FIG. 10 differs from that of FIG. 5 in that the expandable tubes 52 are different: here the expandable tubes 52 are closed at their lower ends. Similarly, the channels 54 are closed at their lower ends. The difference lies in the fact that the expandable tubes 52 are joined together at their upper ends in one piece with a plate 52*x* made of the same material. In this way the problem of sealing the pressure medium to be fed into the expandable tubes 52 is solved in the simplest way.

The particulate molding compound used can in particular be a spray granular compound, produced as described below. A slip contain 40% by weight water and 60% by weight solids was processed. To produce the suspension a dry material was produced which consisted of 50% by weight kaolinite, 25% by weight feldspar and 25% by weigh quartz, the percentages each relating to the total dry weight. The maximum grain size of the kaolinite was 25μ. The maximum grain size of the feldspar and the quartz amounted to 63μ. The feldspar and quartz were introduced in the form of a pegmatite containing both the feldspar and the quartz. The dry material was mixed with the water to a suspension or slip which was then sprayed by means of spray nozzles into a hot-gas atmosphere. In this hot-gas atmosphere spherules formed with a size of from 0 to 500μ, 80% of the total weight lying between 350 and 450μ. The spherules were hollow spherules which could be easily crushed between two fingers of one hand. The residual moisture of the granular material thus obtained amounted to about 3%.

What is claimed is:

1. Apparatus for producing press molded articles having a plurality of cavities therein, from particulate material, comprising:

means defining a mold cavity (34), a plurality of rods (24) arranged to be located within the mold cavity, said rods being sheathed with expandable tubes (52) having a wall surface defining an interior space, and being fitted over the associated said rods in such a way that said rod substantially fills said interior space but is not adhering to said wall surface of said tube along the respective length, said expandable tubes (52) being in contact with said rods (24) along substantially the total length of said expandable tubes and substantially the total circumference thereof as long as said expandable tubes are in a neutral position prior to the application of fluid under pressure, rod support means carrying said sheathed rods, said rod support means being displaceable to move said sheathed rods between a first position inside said mold cavity and a second position outside said mold cavity, vacuum filling means for filling said mold cavity with pressable particulate material, said vacuum filling means comprising air extraction means for applying a vacuum within said mold cavity in the first position of said sheathed rods inside said mold cavity and an inlet opening toward said mold cavity for said particulate material to be filled into said cavity by said vacuum applied to said mold cavity, and means for applying a vacuum to said interior spaces of said expandable tubes to maintain said expandable tubes in contact with said rods when said vacuum is applied to said mold cavity for filling it with said particulate material.

* * * * *